US007819169B2

(12) United States Patent
Pietraszkiewicz et al.

(10) Patent No.: US 7,819,169 B2
(45) Date of Patent: Oct. 26, 2010

(54) HEAT TRANSFERRING COOLING FEATURES FOR AN AIRFOIL

(75) Inventors: Edward F. Pietraszkiewicz, Southington, CT (US); Christina Botnick, Stafford Springs, CT (US); Todd Coons, Gilbert, AZ (US)

(73) Assignee: United Technologies Corporation, Hartford, CT (US)

( * ) Notice: Subject to any disclaimer, the term of this patent is extended or adjusted under 35 U.S.C. 154(b) by 705 days.

(21) Appl. No.: 11/748,070

(22) Filed: May 14, 2007

(65) Prior Publication Data

US 2008/0044282 A1 Feb. 21, 2008

Related U.S. Application Data

(62) Division of application No. 10/984,216, filed on Nov. 9, 2004, now Pat. No. 7,217,095.

(51) Int. Cl.
*B22D 29/00* (2006.01)
*B22D 33/04* (2006.01)
*B22C 9/10* (2006.01)

(52) U.S. Cl. ..... 164/132; 164/137; 164/369

(58) Field of Classification Search ..... 164/369, 164/28, 132, 137
See application file for complete search history.

(56) References Cited

U.S. PATENT DOCUMENTS

| | | | | |
|---|---|---|---|---|
| 3,628,880 | A | 12/1971 | Smuland | |
| 4,358,882 | A | 11/1982 | Wilkinson | |
| 4,627,480 | A | 12/1986 | Lee | |
| 4,767,261 | A | 8/1988 | Godfrey et al. | |
| 5,243,759 | A | 9/1993 | Brown et al. | |
| 5,720,431 | A | 2/1998 | Sellers et al. | |
| 5,931,638 | A | 8/1999 | Krause et al. | |
| 6,174,134 | B1 | 1/2001 | Lee et al. | |
| 6,179,565 | B1 | 1/2001 | Palumbo et al. | |
| 6,769,875 | B2 | 8/2004 | Tiemann | |
| 7,217,095 | B2 * | 5/2007 | Pietraszkiewicz et al. | 416/97 R |

FOREIGN PATENT DOCUMENTS

| | | | |
|---|---|---|---|
| EP | 0154893 | | 9/1985 |
| EP | 0541207 | | 5/1993 |
| EP | 1126134 | | 8/2001 |
| GB | 2 105 624 A | * | 3/1983 |
| GB | 2 358 226 A | * | 7/2001 |
| GB | 2358226 | | 7/2001 |
| JP | 63080004 | | 4/1988 |
| WO | 99/06672 | | 2/1999 |

OTHER PUBLICATIONS

Notice of Preliminary Rejection from the Korean Patent Office dated Nov. 16, 2006.
Extended European Search Report dated Aug. 13, 2009.

* cited by examiner

*Primary Examiner*—Kevin P Kerns
(74) *Attorney, Agent, or Firm*—Carlson, Caskey & Olds

(57) ABSTRACT

A turbine blade airfoil assembly includes a cooling air passage. The cooling air passage includes a plurality of impingement openings that are isolated from at least one adjacent impingement opening. The cooling air passage is formed and cast within a turbine blade assembly through the use of a single core. The single core forms the features required to fabricate the various separate and isolated impingement openings. The isolation and combination of impingement openings provide for the augmentation of convection and film cooling and provide the flexibility to tailor airflow on an airfoil to optimize thermal performance of an airfoil.

10 Claims, 5 Drawing Sheets

HEAT TRANSFERRING COOLING FEATURES FOR AN AIRFOIL

This application is a divisional of U.S. Ser. No. 10/984,216 filed Nov. 9, 2004, now U.S. Pat. No. 7,217,095 issued on May 15, 2007.

The U.S. Government may have certain rights in this invention in accordance with Contract Number N00019-02-C-3003 awarded by the United States Navy.

BACKGROUND OF THE INVENTION

This invention relates generally to a cooling passage for an airfoil. More particularly, this invention relates to a core assembly for the formation of cooling passages for an airfoil.

A gas turbine engine typically includes a plurality of turbine blades that transform energy from a mainstream of combustion gasses into mechanical energy that rotates and drives a compressor. Each of the turbine blades includes an airfoil section that generates the rotational energy desired to drive the compressor from the flow of main combustion gasses.

The turbine blade assembly is exposed to the hot combustion gasses exhausted from the combustor of the gas turbine engine. The temperature of the combustion gasses exhausted through and over the turbine blade assemblies can decrease the useful life of a turbine blade assembly. It is for this reason that each turbine blade is provided with a plurality of cooling air passages. Cooling air is fed through each of the turbine blades and exhausted out film holes on the surface of the turbine blade. The position of the film holes on the turbine blade creates a layer of cooling air over the surfaces of the turbine blade. The cooling air insulates the turbine blade from the hot combustion gasses. By insulating the turbine blade from exposure to the hot combustion gasses the turbine blade reliability and useful life is greatly extended.

Typically, the cooling passages within a turbine blade are formed by a ceramic core that is provided with and surrounded with molten material that is used to form the turbine blade. Once the molten material utilized to form the turbine blade is solidified the core material is removed. Removing the core material leaves the desired cooling air passages along with the desired configuration of film cooling holes.

As appreciated, each turbine blade assembly represents a dead end or an end of a cooling airflow path. This is so because cooling air flowing from an inner side or platform of the turbine blade flow radially outward to a tip of the turbine blade. The tip of the turbine blade is closed off forming the end of the cooling air passage. Accordingly, the only exit for cooling air through the turbine blade is through the plurality of the film cooling holes disposed about and on the surface of the turbine blade. The configuration and quantity of the film holes for cooling the turbine blade is determined to produce a desired flow rate of cooling air.

The shape of the turbine blade varies throughout the cross section from a leading edge of the turbine blade to a trailing edge. The leading edge is most often much thicker than the trailing edge. However, the cooling needs in the trailing edge are often greater than those in the leading edge and therefore require cooling passages arranged within a close proximity to the trailing edge. As appreciated, cooling passages within the thinner edge section are much smaller. The smaller cooling passages require smaller core assemblies to form those cooling passages. As the size of the core assemblies are reduced the susceptibility to damage during the molding operation increases. The smaller core assemblies required the desired cooling passage in the thinner sections of the turbine blade and are more susceptible to damage during manufacturing.

Accordingly, it is desirable to develop a core assembly that is robust enough to provide for reliable manufacturing process results while still providing for the formation of the smaller cooling air passages in the thinner sections of the turbine blade assembly.

Another concern in the design and configuration of cooling air passages is the direction of cooling air on an inner side of the cooling passage. The cooling passage typically receives air from a main core section. The main core section of the turbine blade is in turn in communication with a cooling air source. The cooling air passage therefore includes an inner surface that is adjacent the main core and an outer surface that is adjacent an exterior surface of the turbine blade. Impingement holes within the cooling air passages communicate air from the main core into the cooling air passage and against the outer surface.

Accordingly, it is desirable to develop a core assembly to form a cooling air passage within a turbine blade assembly that is both reliable during manufacturing processes and that provides the desirable cooling air flow properties to maximize to heat transfer capabilities applications.

SUMMARY OF THE INVENTION

A sample embodiment of this invention includes a turbine blade assembly having cooling passages where each of the impingement holes is isolated from at least some of the other impingement holes. The isolation of the impingement holes within the cooling passages provides for the direction of cooling airflow to specific desired areas. Further, the core assembly utilized for forming the cooling air passages provides a series of structures that strengthen and improve manufacturability.

An example turbine blade assembly of this invention is formed with a cooling air passage that is in communication with a main core. The main core is in turn in communication with cooling air from other systems. The cooling passage is formed through the use of a unique core assembly that includes a plurality of impingement holes that are isolated from each other. Isolating each of the impingement holes from at least some of the other impingement holes prevents cross flow between impingement holes to improve cooling air flow against an outer surface of the cooling passage.

The core assembly provides the configuration of the cooling passages and includes impingement structures for forming the impingement openings. Each of the impingement structures is isolated from at least some of the other impingement structures by separation structures. The separation structures form the channels within the cooling passages that isolate the impingement openings. Each of the channels formed by the core assembly is in communication with expanded chambers at a side of the cooling passage. Within the expanded chamber are film structures that are provided for creating the film openings between the cooling air passage and an exterior surface of the turbine blade assembly.

Accordingly, the turbine blade assembly of this invention includes cooling air passages that provide desirable cooling characteristics for the turbine blade.

These and other features of the present invention can be best understood from the following specification and drawings, the following of which is a brief description.

DETAILED DESCRIPTION OF THE PREFERRED EMBODIMENT

Figure 1A:
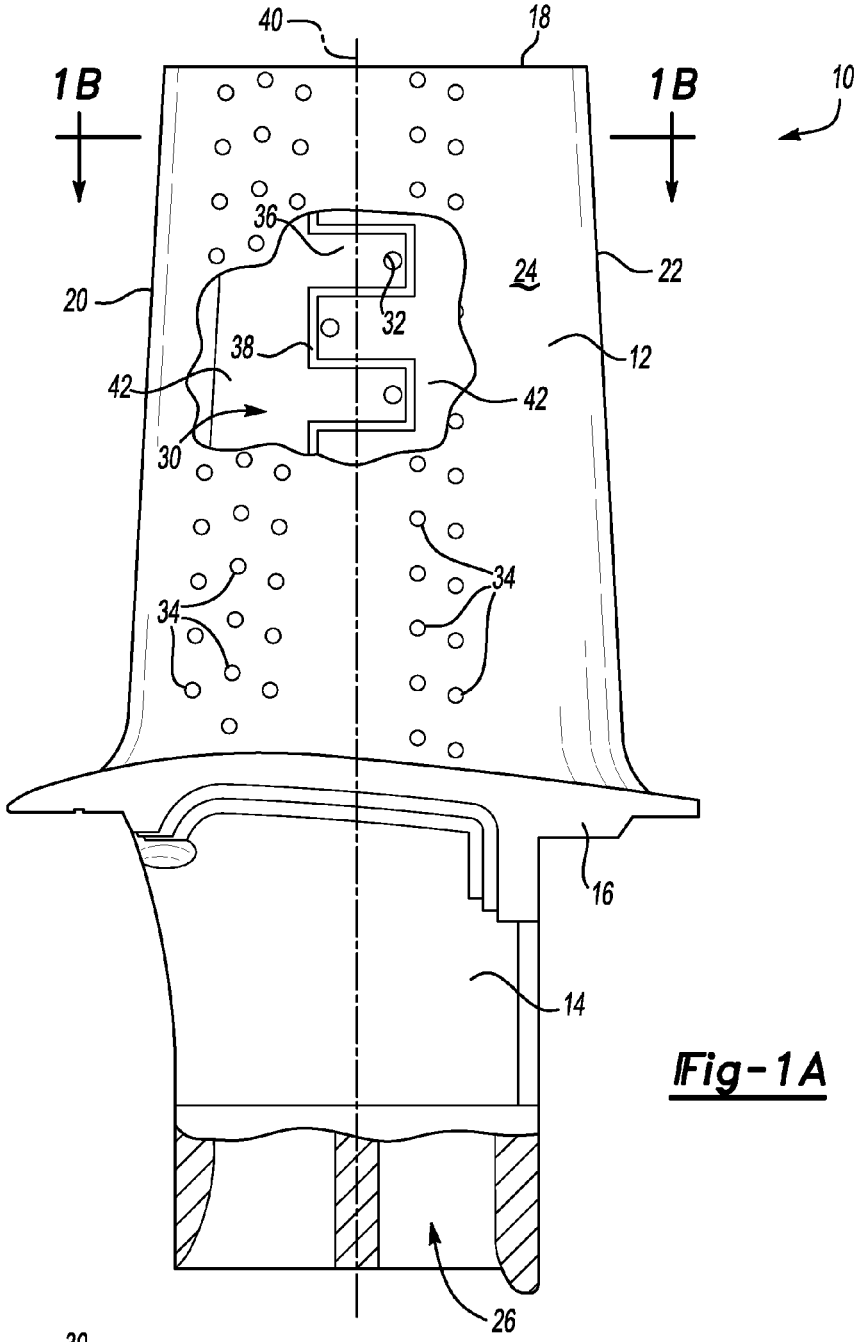
FIG. 1A is a side view of a turbine blade assembly according to this invention.
Figure 1B:
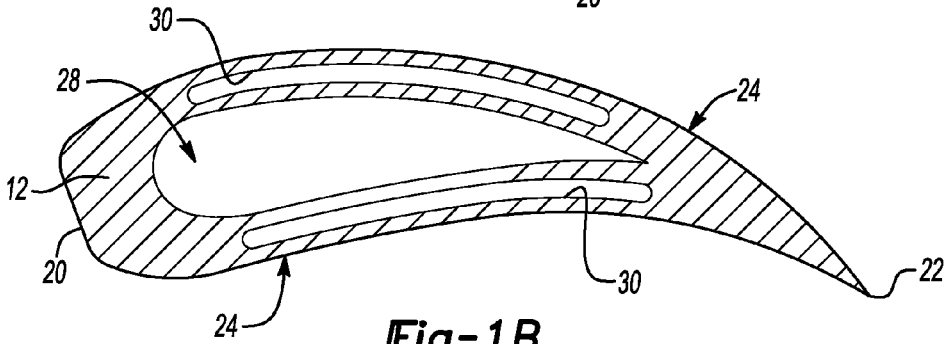
FIG. 1B is a cross-section view of a portion of the turbine blade assembly.

Referring to FIGS. 1A and 1B, turbine blade assembly 10 includes an airfoil section 12, a root section 14, and a platform section 16. The root section 14 extends into a hub portion (not shown) as is known in the art. The root section 14 extends to the platform section 16. The airfoil 12 extends upwardly from the platform section 16. Turbine airfoil section 12 extends from the platform section 16 to a tip 18. The turbine blade assembly 10 includes a leading edge 20 and a trailing edge 22. Between the leading edge 20 and the trailing edge 22 is the exterior surface 24. The exterior surface 24 is shaped to provide the desired transition or conversion of gas stream flow to rotational mechanical energy. As should be understood, the turbine blade assembly 10 as is shown in FIG. 1A is as is known to a worker skilled in the art. A worker skilled in the art with the benefit of this disclosure would understand that other airfoil configurations utilized in different applications would benefit from the disclosures and cooling passages of this invention.

The turbine blade assembly 10 includes a cooling passage 30. The cooling passage 30 is disposed within the turbine blade assembly 10. Cooling air enters the turbine blade assembly 10 through passages 26 within the root section 14. Cooling air enters through the passages 26 into a main core 28 (FIG. 1B). Main core 28 is a hollow portion within the interior of the turbine blade assembly 10. Cooling air communicated through the passages 26 and into the main core 28 enters cooling passages 30 disposed within the turbine blade assembly 10. Cooling air enters the cooling passages 30 from the main core 28 through a plurality of impingement openings 32.

Cooling airflow from the impingement openings 32 flows toward expansion chambers 42 disposed opposite the impingement opening 32. Cooling airflow then proceeds through the walls of the turbine blade assembly 10 through film openings 34. Cooling air exiting the cooling passage 30 through the film openings 34 flows over the exterior surface 24 of the turbine blade assembly 10 to provide a cooling and insulating layer of air.

The turbine blade assembly 10 of this invention includes the cooling passage 30. Each of the cooling passages 30 includes the impingement openings 32. The impingement openings 32 are isolated from each other by channels 36. The channels 36 are formed by a series of separating structures 38. Separation and isolation of each of the impingement openings 32 provides for the separation of cooling flow that is impinged upon an outer surface of the cooling passage 30. Further, isolation of adjacent impingement openings 32 prevents and reduces cross flow problems encountered with typical conventional prior art impingement opening designs. The flow from the impingement openings 32 passes through the channel 36 to the plurality of film holes 34. Film holes 34 are in communication with the expanded chamber 42. The expanded chamber 42 provides a portion of the cooling passage for the accumulation of cooling air that is to be communicated to the film openings 34. The accumulation of cooling air within the expanded chamber 42 reduces problems associated with back wall strikes corresponding with impingement openings 32.

Figure 2:
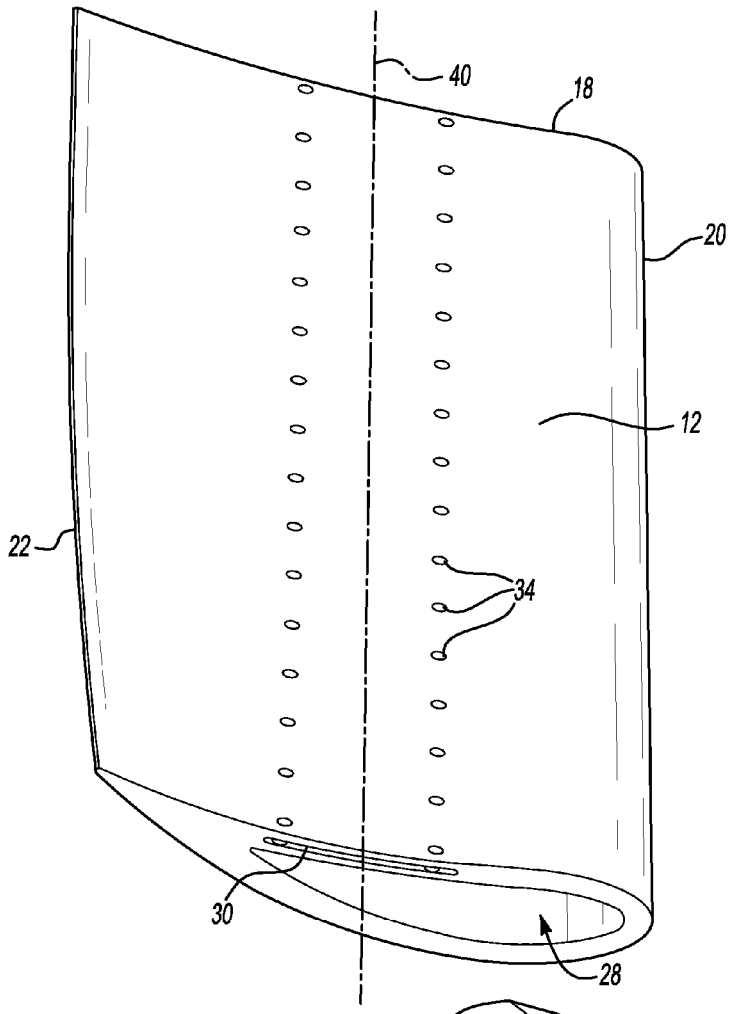
FIG. 2 is a prospective view of an airfoil assembly.

Referring to FIG. 2, a prospective view of the airfoil 12 is shown to illustrate the configuration of the main core 28. The main core 28 provides for communication of cooling air up through the central portion of the turbine blade assembly 10 and to communicate with cooling passages 30. The specific shape and configuration of the turbine blade assembly and the airfoil 12 illustrated in FIG. 2 is as known. A worker with the benefit of the disclosure would understand that many different types of airfoil configurations will benefit from this the cooling passage configuration illustrated and described within this disclosure.

Figure 3:
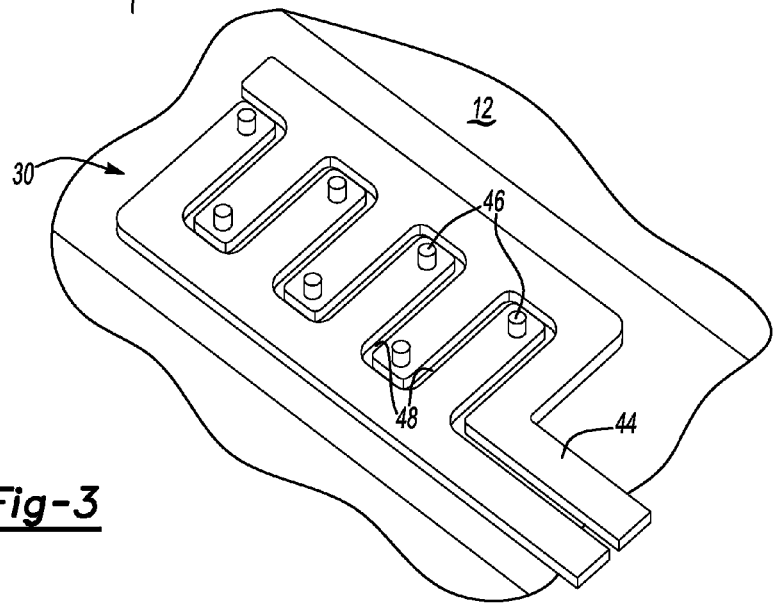
FIG. 3 is a prospective view of a portion of a core assembly according to this invention.

Referring to FIG. 3, the cooling passage 30 is formed within the turbine blade assembly 10 through the use of core assembly 44. The core assembly 44 provides for the formation of the various structures and configuration including openings, channels of the cooling passage during fabrication of the turbine blade assembly 10. Conventionally, the turbine blade assembly 10 is fabricated through the use of a conventional molding process. The core assembly 44 can be fabricated from known core materials such as specially formulated ceramic and refractory metals. The core assembly 44 is placed within a mold and then surrounded by molten material that will comprise the turbine blade assembly 10. Upon solidification of the material forming the turbine blade assembly 10, the core assembly 44 is removed. Removal of the core assembly 44 is as known and can comprise various processes including leeching or oxidation process where a chemical are used to destroy and leech out the core assembly 44. As appreciated, a worker versed in the art with the benefit of this disclosure would understand that the use of other molding process and materials as are known are within the contemplation and scope of this invention. The type of removal process that is utilized to remove the core 44 from the turbine blade assembly 10 will depend on various factors. These factors include the type of turbine blade material, the type of core material used and the specific configuration of the cooling air passage.

The core assembly 44 utilized to form intricate cooling air passages required to provide the desired cooling properties within the turbine blade assembly 10. The core assembly 44 includes impingement structures 46 that extend and provide formation of the impingement openings 32 within a completed turbine assembly 10. Core assembly 44 also includes separation structures 48 that form the channels and walls that are required for isolating each of the impingement openings 32 from at least another of the impingement openings 32.

Figure 4:
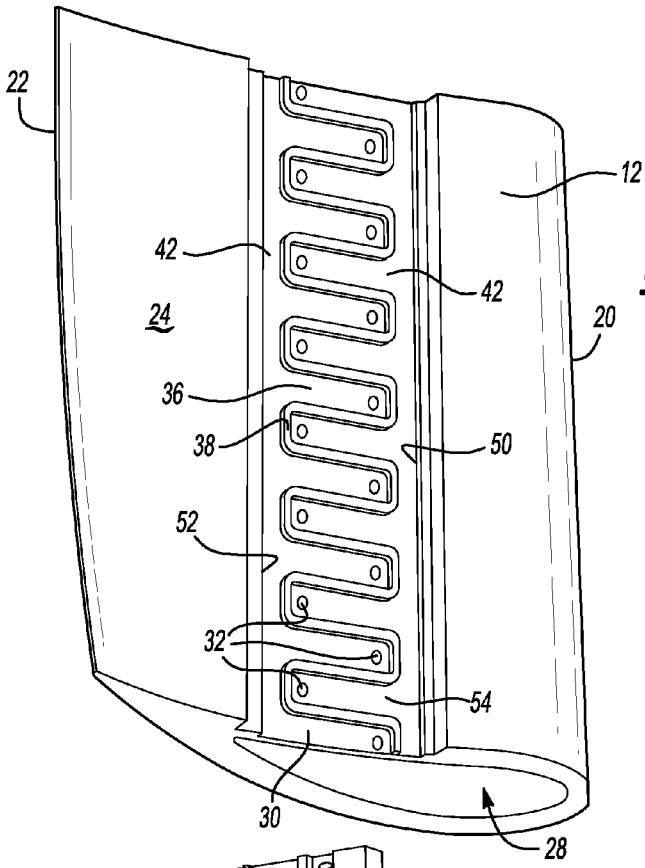
FIG. 4 is a prospective view of an airfoil assembly according to this invention with a portion broken away to illustrate the cooling air passage.

Referring to FIG. 4, an airfoil 12 is shown with a portion of the surface removed to illustrate the specific features of the cooling air passage formed therein. The cooling air passage 30 includes the expanded chambers 42 on each side of the cooling air passage 30. The cooling air passage 30 includes a lead edge side 50 and a trailing edge side 52. Each side of the cooling air passage 30 includes an expansion chamber 42. Adjacent impingement openings 32 communicate with an expansion chamber 42 disposed on an opposite side of the cooling air passage 30. No two adjacent impingement openings communicate cooling air to a common expansion chamber 42. In this way the specific cooling flow can be controlled and tailored to provide cooling to specific areas and features of the airfoil 12.

Figure 5:
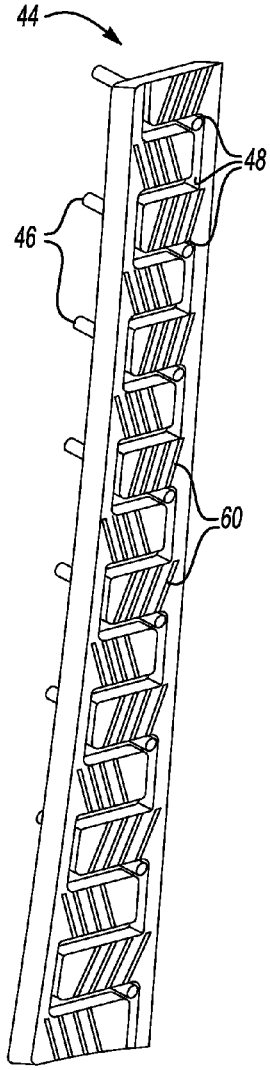
FIG. 5 is a prospective view of a core assembly according to this invention.

Referring to FIG. 5, an example core assembly 44 is shown and includes the impingement structures 46 utilized to form the impingement openings 32 within the airfoil 12. The impingement openings 32 communicate cooling air from the main core 28 into the cooling passage 30. The core assembly 44 also includes the separation structures 48 that utilize and provide for the separation of cooling air through each adjacent impingement opening 32. The core assembly 44 includes a reverse structure from that which will be formed within the completed turbine blade airfoil 12. The impingement structures 46 therefore are extensions that will extend through and provide the openings through the airfoil 12 to the main core 28. The structure and space of the core assembly 44 provides for the open spaces within the completed airfoil 12.

The core assembly 44 also includes a plurality of heat transfer enhancement features 60. These heat transfer enhancement features 60 are formed in the core assembly 44 as openings such that within the completed cooling air passage 30 the heat transfer enhancement features 60 will form a plurality of ridges that extend upward within the various of the cooling air passage 30. A worker with the benefit of this disclosure would understand that different shapes of the heat transfer enhancement features 60 other than the examples illustrated that disrupt or direct airflow are within the contemplation of this invention.

Figure 6:
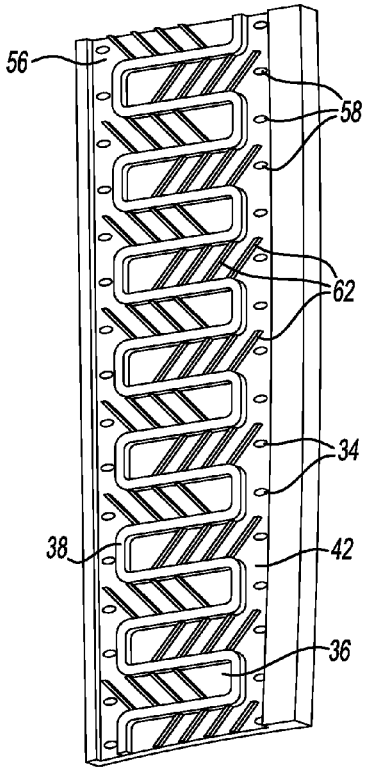
FIG. 6 is a view of an exterior surface of a cooling passage.

Referring to FIG. 6, an outer side 56 is illustrated. The outer side 56 is cut away from the airfoil 12 illustrated in FIG. 4. The outer side 56 is not typically sectioned as is shown in FIG. 6 but is an integral portion of the airfoil 12. The outer side 56 is adjacent the exterior surface of the airfoil 12. FIG. 4 illustrates an inner side 54 of the cooling passage 30. The inner side is adjacent the main core 28. It is for this reason that the ridges 62 are provided on the outer side 56 illustrated in FIG. 6. As appreciated, thermal energy radiates along the exterior surface 24.

The outer side 56 that is adjacent the exterior portion of the airfoil 12 is provided on which cooling air flow can most affect desired heat absorption and transfer. Airflow through the impingement openings 32 strikes the outer sides 56 immediately across from the impingement openings 32. Airflow will then proceed as directed by the channels 36 towards the trailing edge or leading edge side towards the expansion chamber 42. Through the channels 36 air will be controlled and tailored to create turbulent effects that increase heat transfer and absorption properties. Once air has reached the expansion chambers 42 it is accumulated and exhausted out the film holes 34. Through the film holes 34 the air will then be exhausted into the main combustion gas stream. The example core assembly 44 is substantially straight. However, the core assembly 44 may include a curved shape to conform to an application specific airfoil shape.

Figure 7:
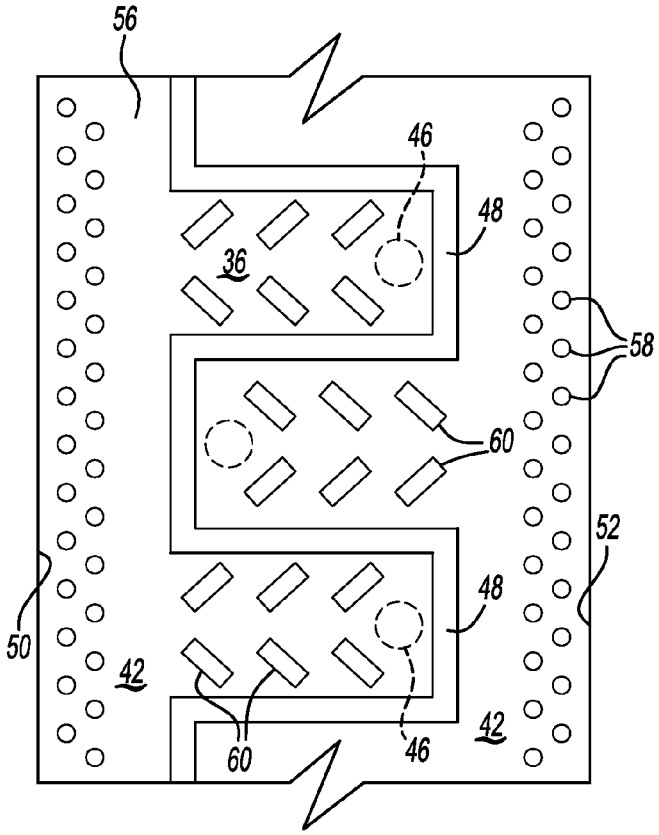
FIG. 7 is a plan view of a side of a core assembly according to this invention.

Referring to FIG. 7, a portion of the core assembly 44 is shown that provides for the formation of the outer side 56 of the cooling air passage 30. The core assembly 44 includes the structures that form the channels 36, film holes 34, and separating structures 38. The impingement structures 46 are illustrated in dashed lines to indicate that they do not extend outwardly from this side of the core 44. Instead the impingement openings are formed from extensions or structures 46 that extend from an opposite side of the core. This side of the core assembly 44 produces these features within the outer side 56 of the cooling air passage 30 of the completed airfoil 12. In this example core assembly 44, each impingement structure 46 it opens into a separate channel 36. Therefore each of the impingement openings 32 are isolated from any of the adjacent the impingement openings 32. Within each of the channels are a plurality of the heat transfer enhancement structures 60 that will form the desired ridges and heat transfer ridges 62 within the completed channels 36. The heat transfer structures 60 illustrated in FIG. 7 are cavities that receive material during the molding process to form the outwardly extended ridges.

Figure 8:
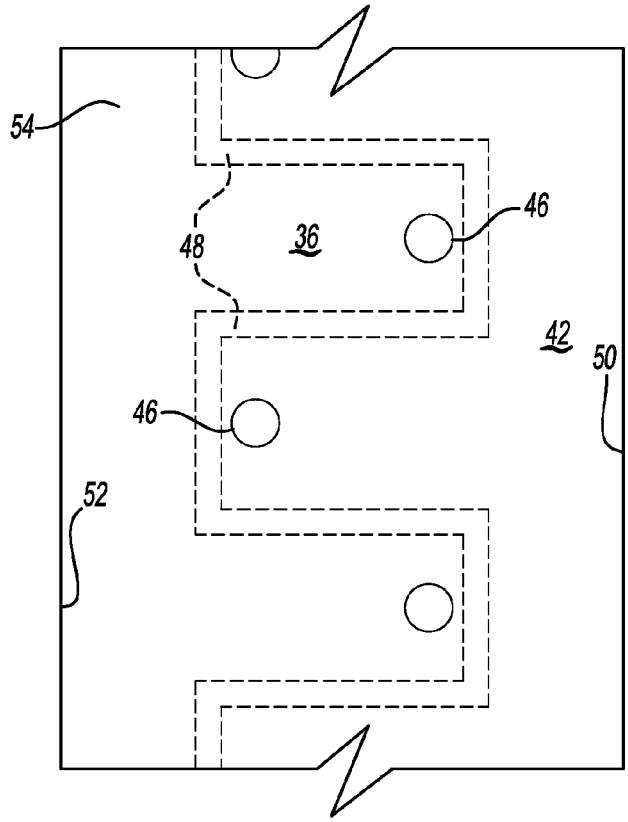
FIG. 8 is a plan view of the other side of a core assembly as shown in FIG. 7.

Referring to FIG. 8, an inner side of the core assembly 44 is shown and includes the impingement structures 46. The separation structures 48 are shown in dashed lines to indicate that they would not extend from this side but would extend from the opposite side. Further, the other structures that would be formed on the outer side 56 from the inner side 54 are not shown for clarity purposes. However, as appreciated those features would extend outwardly from the opposite side and may also be represented by dashed lines in this view.

Figure 9:
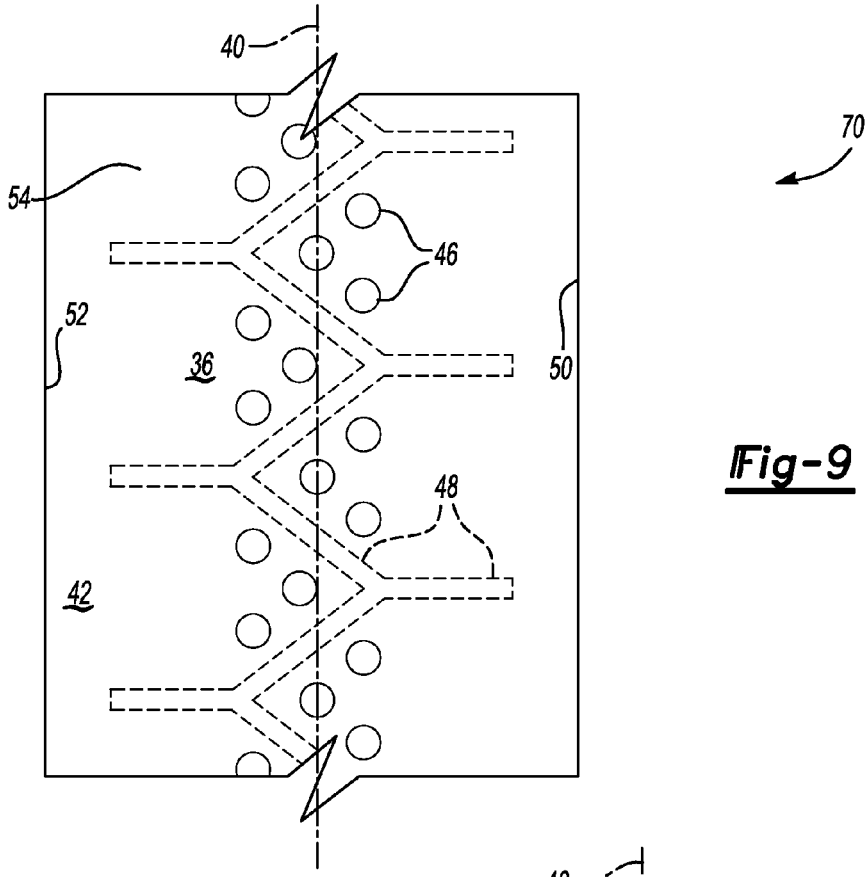
FIG. 9 is a view of one side of a core assembly according to this invention.
Figure 10:
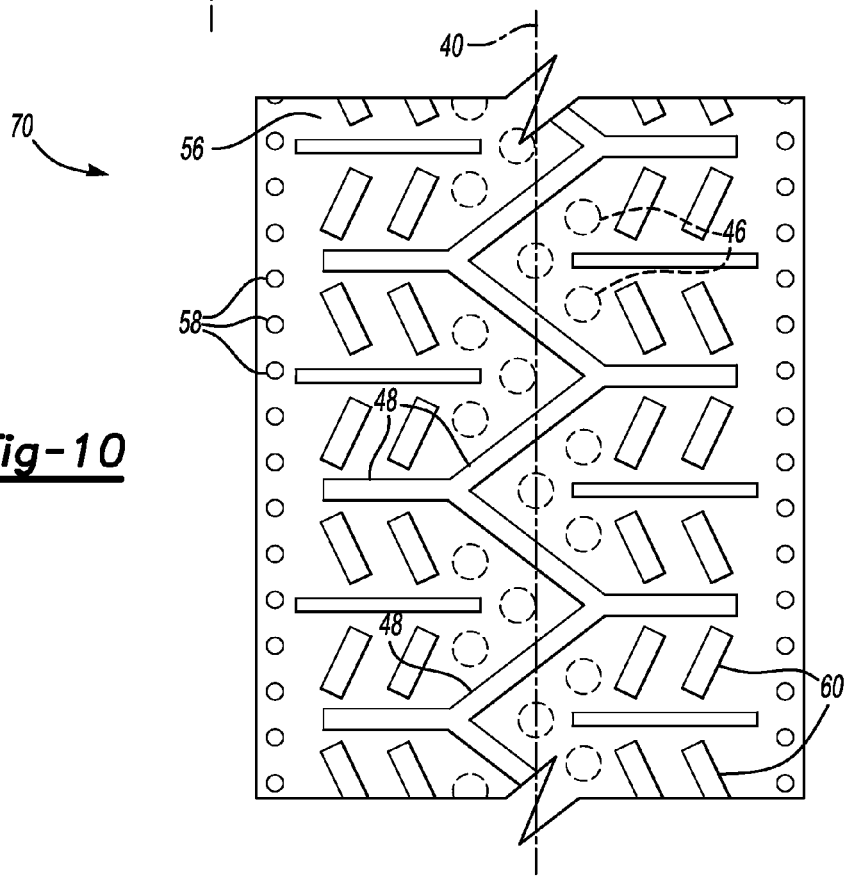
FIG. 10 is a view of an opposite side of a core assembly illustrated in FIG. 9.

Referring to FIGS. 9 and 10, another example core assembly 70 according to this invention, includes a plurality of impingement structures 46 disposed within separate channels 36. In this core assembly 70, three impingement structures 46 are disposed within each of the separation channel 36. By providing several impingement openings within each chamber the specific air flow requirements and cooling airflow impingement on a specific area can be tailored to accommodate area specific heat transfer and absorption requirements. Although there are several impingement openings 46 disposed within each channel 36. These are still isolated from at least one impingement opening is isolated from at least another impingement opening. Further, the impingement openings are all disposed about a centerline 40.

Although each of the impingement openings 32 are disposed about a common centerline 40 they are still isolated from at least one other impingement opening. Although it is shown in the example core assembly 70 that the impingement openings and impingement structures 46 are disposed about a centerline 40, other configurations and locations of impingement openings are within the contemplation of this invention. A worker versed in the art will understand that isolation of at least one impingement opening relative to another impingement opening provides the desired benefits of tailoring cooling in a cooling passage.

Referring to FIG. 10, the core assembly 70 is shown on the side opposite that shown in FIG. 9 and illustrates the side of the core assembly 70 that would form the outer side 56 of the cooling air passage 30. This side of the core assembly 70 illustrates the film structures 58 that would form the film holes 34 in the completed airfoil 12. Further, heat transfer structures 60 are illustrated that would form the heat transfer ridges 62 (best shown in FIG. 6) in the completed cooling passage 30. Further, as is shown, the impingement structures 46 are shown in dashed lines indicate their location relative to the features formed on the outer side 56. As can be seen by FIG. 10 the separation structures 48 and the heat transfer structures 60 provide for the creation of a tailored cooling airflow from the impingement openings to the film openings.

Accordingly, the core assembly 44 and airfoil 12 of this invention provides for the tailoring and improvement of cooling air properties within a turbine blade assembly 10. Further, the core assembly 44 includes a single core that can provide a plurality of individual channels desirable for separating airflow through each of the impingement hole openings. The isolation of the impingement openings provides improved airflow and tailoring capabilities for implementing and optimizing local cooling and flow characteristics within an airfoil.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of forming cooling passages for an airfoil assembly comprising the steps of:

(a) forming a first core including impingement structures for forming impingement openings and separation structures for forming channels isolating each of the impingement openings from any other impingement openings;

(b) casting the airfoil assembly with the first core of step (a) disposed within a mold; and (c) removing the first core from the cast airfoil assembly, wherein the cooling passages include channels isolating adjacent airflow communicated through adjacent impingement openings.

2. The method as recited in claim 1, wherein said step (a) includes forming a plurality of film hole structures for forming a corresponding plurality of film holes in the airfoil assembly.

3. The method as recited in claim 1, wherein said step (a) includes forming the separation structures for forming the channels such that a portion of each channel interfits within another of the channels.

4. The method as recited in claim 1, including the step of forming a main core for forming a main cavity within the airfoil assembly for receiving and communicating cooling air to the cooling passages formed by the first core.

5. The method as recited in claim 1, wherein said step (a) includes forming a plurality of turbulation structures for forming a corresponding plurality of turbulation features within the cooling passage of the airfoil assembly.

6. A method of forming an airfoil assembly comprising:

forming a first core including structures for forming impingement openings for communicating air from a main cavity against an interior surface of an outer wall of the airfoil assembly, and at least one structure for forming a divider that isolates adjacent impingement openings;

supporting the first core within a mold;

casting the airfoil assembly with the first core to form a first cavity including impingement openings in communication with a main cavity and the divider isolating adjacent impingement openings; and removing the first core from the cast airfoil assembly.

7. The method as recited in claim 6, including forming the structure for forming the divider to include structures that form a wall extending between a top surface and a bottom surface of the first cavity.

8. The method as recited in claim 6, including forming the structure for forming the divider to include structures that form a wall that separates each of the impingement openings from each adjacent impingement opening.

9. The method as recited in claim 8, including forming the first core with structures for forming the first cavity to include a first expansion chamber and a second expansion chamber in the cast airfoil assembly separated by the divider.

10. The method as recited in claim 9, wherein the each adjacent impingement opening formed by the first core communicates cooling air flow to a different one of the first and second expansion chambers.

* * * * *